US007472677B2

(12) United States Patent
Klassen et al.

(10) Patent No.: US 7,472,677 B2
(45) Date of Patent: Jan. 6, 2009

(54) ENERGY TRANSFER MACHINE

(75) Inventors: James Klassen, Langley (CA); David W. Boehm, Summerland (CA)

(73) Assignee: Concept Solutions, Inc., Langley, British Columbia (CA)

( * ) Notice: Subject to any disclaimer, the term of this patent is extended or adjusted under 35 U.S.C. 154(b) by 41 days.

(21) Appl. No.: 11/465,664

(22) Filed: Aug. 18, 2006

(65) Prior Publication Data

US 2007/0251491 A1 Nov. 1, 2007

Related U.S. Application Data

(60) Provisional application No. 60/746,026, filed on Apr. 29, 2006, provisional application No. 60/595,933, filed on Aug. 18, 2005.

(51) Int. Cl.
*F02B 53/00* (2006.01)
*F01C 1/10* (2006.01)
*F01C 1/20* (2006.01)

(52) U.S. Cl. ..... 123/241; 123/246; 123/204; 418/170; 418/171; 418/165; 418/167; 418/169

(58) Field of Classification Search ..... 123/246, 123/241, 406.62, 211, 228; 418/170–171, 418/167, 169; 137/469
See application file for complete search history.

(56) References Cited

U.S. PATENT DOCUMENTS

| | | | | | |
|---|---|---|---|---|---|
| 726,896 | A | * | 5/1903 | Franzen | 418/167 |
| 3,810,721 | A | | 5/1974 | Eyer | 418/170 |
| 3,850,150 | A | * | 11/1974 | Plevyak | 418/167 |
| 4,096,763 | A | | 6/1978 | Kell | 74/69 |
| 4,121,619 | A | * | 10/1978 | Pauliukonis | 137/469 |
| 4,274,374 | A | | 6/1981 | Lee | 123/241 |
| 4,316,439 | A | | 2/1982 | Tyree | 123/229 |
| 4,324,296 | A | * | 4/1982 | Schenk et al. | 123/228 |
| 4,527,522 | A | * | 7/1985 | Cerny | 123/406.62 |
| 4,553,513 | A | * | 11/1985 | Miles et al. | 123/204 |
| 4,932,850 | A | | 6/1990 | Valavaara | 418/171 |
| 5,067,456 | A | | 11/1991 | Beachley et al. | 123/197.4 |
| 6,305,345 | B1 | | 10/2001 | Bakhtine | 123/245 |
| 6,893,238 | B2 | | 5/2005 | Eisenmann | 417/171 |

(Continued)

FOREIGN PATENT DOCUMENTS

CA 2419068 9/2003

(Continued)

OTHER PUBLICATIONS

International Search Report for PCT/CA2006/001356.

(Continued)

*Primary Examiner*—Thai-Ba Trieu
(74) *Attorney, Agent, or Firm*—Stephen M. Nipper; Dykas, Shaver & Nipper, LLP

(57) ABSTRACT

An energy transfer machine, for example, a positive displacement internal combustion device, has a fixed outer housing, an internal rotating carrier and one or more inner rotors with rotational axes which are offset from the inner rotor carrier rotational axis. Projections from the fixed outer housing and rotor mesh with each other to define variable volume chambers. In another energy transfer machine, in which the outer housing may be fixed or rotating, projections of the rotor are expandable within cylinders defined by projections of the outer housing.

36 Claims, 13 Drawing Sheets

U.S. PATENT DOCUMENTS

| | | | | |
|---|---|---|---|---|
| 6,932,047 | B2 * | 8/2005 | Watkins et al. | 123/241 |
| 7,111,606 | B2 * | 9/2006 | Klassen | 123/246 |
| 7,185,625 | B1 | 3/2007 | Guan et al. | 123/246 |
| 2003/0209221 | A1 | 11/2003 | Klassen | 123/239 |
| 2004/0009085 | A1 | 1/2004 | Lamparski et al. | 417/171 |
| 2007/0084434 | A1 * | 4/2007 | Leon | 123/241 |
| 2007/0295301 | A1 * | 12/2007 | Klassen t al. | 123/211 |

FOREIGN PATENT DOCUMENTS

| | | | |
|---|---|---|---|
| DE | 4242966 | A1 | 6/1994 |
| GB | 385797 | | 5/1933 |
| GB | 396857 | | 8/1933 |
| GB | 509372 | | 7/1939 |
| JP | 11072001 | A | 3/1999 |
| JP | 2001012201 | A | 1/2001 |
| WO | WO 200263140 | A2 * | 8/2002 |
| WO | 2007019703 | | 2/2007 |

OTHER PUBLICATIONS

International Search Report for PCA/CA2007/000730.

* cited by examiner

ENERGY TRANSFER MACHINE

CROSS-REFERENCE TO RELATED APPLICATIONS

This application claims the benefit under 35 USC 119(e) of application Ser. No. 60/595,933 filed Aug. 18, 2005 and application Ser. No. 60/746,026 filed Apr. 29, 2006.

BACKGROUND

US Patent publication 20030209221 (the '221 publication, published Nov. 13, 2003) discloses a two-dimensional rotary displacement device comprises a housing, an outer rotor and at least one inner rotor. The axes of rotation of the outer rotor and the at least one inner rotor are parallel. This geometry provides problems such as gyroscopic forces and centrifugal loading of the outer rotor associated with the large spinning mass of the outer rotor.

SUMMARY

An energy transfer machine is provided that uses at least one internal rotor spinning on a shaft. The shaft is fixed to a rotating carrier. As the carrier rotates, the inner rotor spins around the shaft and meshes with a fixed outer stator. The inner rotor and outer stator mesh together in such a way that positive displacement chambers are formed which change volume as the carrier rotates. These variable volume chambers may be used for example as combustion chambers in an internal combustion engine or to drive or be driven by fluid or gas. The inner rotor has outward projections, which may be referred to as for example lobes or teeth or vanes or protrusions. The outward projections may function as pistons. The stator has inward projections, which mesh with the outward projections of the inner rotor. The inward projections may be referred to as for example lobes or teeth or vanes or protrusions. The inward projections may function as the walls of cylinders, in which the outward projections move to create the variable volume chambers. More than one inner rotor with outward projections of the inner rotor meshing with the inward projections of the outer stator may be used.

In a method of operating an energy transfer machine, an inner rotor is caused to rotate within a carrier, where the carrier rotates in relation to an outer stator. Projections on the inner rotor mesh with projections on the stator to create variable volume chambers as the inner rotor rotates within the carrier. The inner rotor is caused to rotate by expansion of gases within the variable volume chambers or by rotation of the carrier.

These and other features of energy transfer machines are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
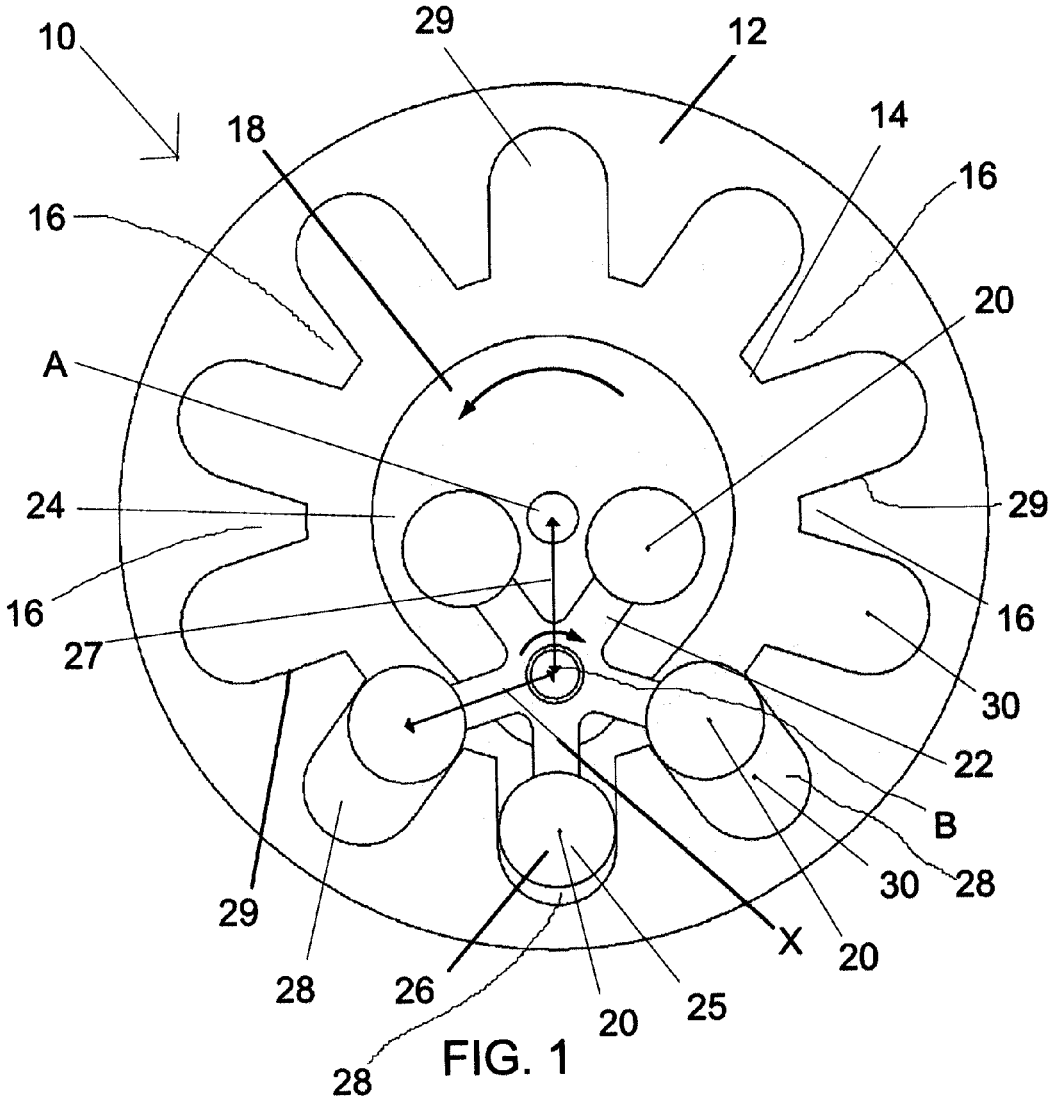
FIG. 1 is a schematic of an energy transfer machine with a rotating carrier.

Referring to FIG. 1, there is shown an energy transfer machine 10 that has an outer stator 12 having an inward facing surface 14 and inward projections 16 arranged around the inward facing surface 14. A carrier 18 is secured for rotation, about an axis A, at least partly within the outer stator 12. An inner rotor 22 is secured for rotation about an axis B within the carrier 18. Axis A is parallel to axis B. The inner rotor 22 has an outward facing surface 24 and outward projections 26 arranged around the outward facing surface 24. The inward projections 16 project inward and the outward projections 26 project outward to mesh with each other and define variable volume chambers 28 between the inward projections 16 and the outward projections 26 as the inner rotor 22 rotates within the carrier 18. Fluid transfer passages, not shown in FIG. 1, are provided on at least one of the outer stator 12 and carrier 18 to permit flow of fluid into and out of the variable volume chambers 28. The parts shown may be made of any suitable material, including ceramic.

In the schematic of FIG. 1, the outward projections 26 of the inner rotor 22 are shown as an array of pistons 25 with center points 20 which are located a radius X from the rotational axis B of the inner rotor 22. The pistons 25 are shown with circular cross-section, but may have other shapes, and in particular the circular cross-section represents a section through a piston that may have various shapes that would fit in a corresponding cylinder such as spherical, conical, truncated conical or cylindrical. The length of radius X is equal to the offset distance 27 from the inner rotor rotational axis B to the carrier rotational axis A. The inward projections 16 of the outer stator 12 form an array of cylinders 29 each with a center axis which are all on the same plane as the spherical piston center points and which coincide at the carrier rotational axis A. Thus, in this embodiment, the outer stator 12 has twice as many cylinders 29 as the inner rotor 22 has spherical pistons 25.

As the carrier 18 rotates, in this example, the spherical pistons 25 intermittently enter the cylinders 29 formed by inward projections 16 and compress the gas contained within the cylinders 29. This gas may then be expelled from the cylinders 29 by means of a one way valve (as for a compressor or vacuum pump application shown in FIGS. 7-10). Alternatively, fuel can be injected and combusted (as with a diesel engine application) or an air/fuel mixture may be drawn or charged into the intake before the pistons 25 seal with the cylinders 29 formed by inward projections 16. This mixture may be combusted at or near maximum compression in an engine embodiment is shown for example in FIGS. 2-6. Combustion may be initiated either by spark or some other type of ignition method, or by detonation if the temperature of the cylinder 29 and pistons 25 together with the heat of compression is high enough.

An embodiment with spherical pistons 25 and cylindrical cylinders 29 formed by inward projections 16 is a simple example used primarily for explanation. However, it may have benefits with regards to machining simplicity for certain applications; for example with relatively low pressure vacuum pump or compressor applications. Many other geometries may be used with this machine having a fixed outer stator 12 and rotating carrier 18, if the geometries provide a positive displacement characteristic for all or part of the compression and/or expansion phase of each piston-cylinder mesh.

Other positive displacement geometries may be used with a rotating carrier 18 and fixed outer stator 12. For example, although the number of projections Ns on the stator may be an integer multiple of the number of projections Nr on the inner rotor, this is not necessary in some embodiments. Hence, for example, in one embodiment Ns=Nr+1. For the piston 25 geometry, cylindrical or other shaped pistons (such as tapered cone or partial cone section) may be used as long as the piston, cylinder, or cone section center axis is perpendicular or nearly perpendicular to the rotational axis B of the inner rotor and carrier rotational axis A. Cylinder 29 shapes correspond to the shape of the pistons 25 to provide a positive displacement, sealed chamber for all or part of the compression and/or expansion. For example, a piston 25 with circular cross-section in the plane of FIG. 1 may have a square, trapezoidal or circular cross-section in a plane perpendicular to a radius of the inner rotor passing through the piston 25, in the case where the piston 25 is cylindrical, truncated conical or spherical respectively.

Figure 2:
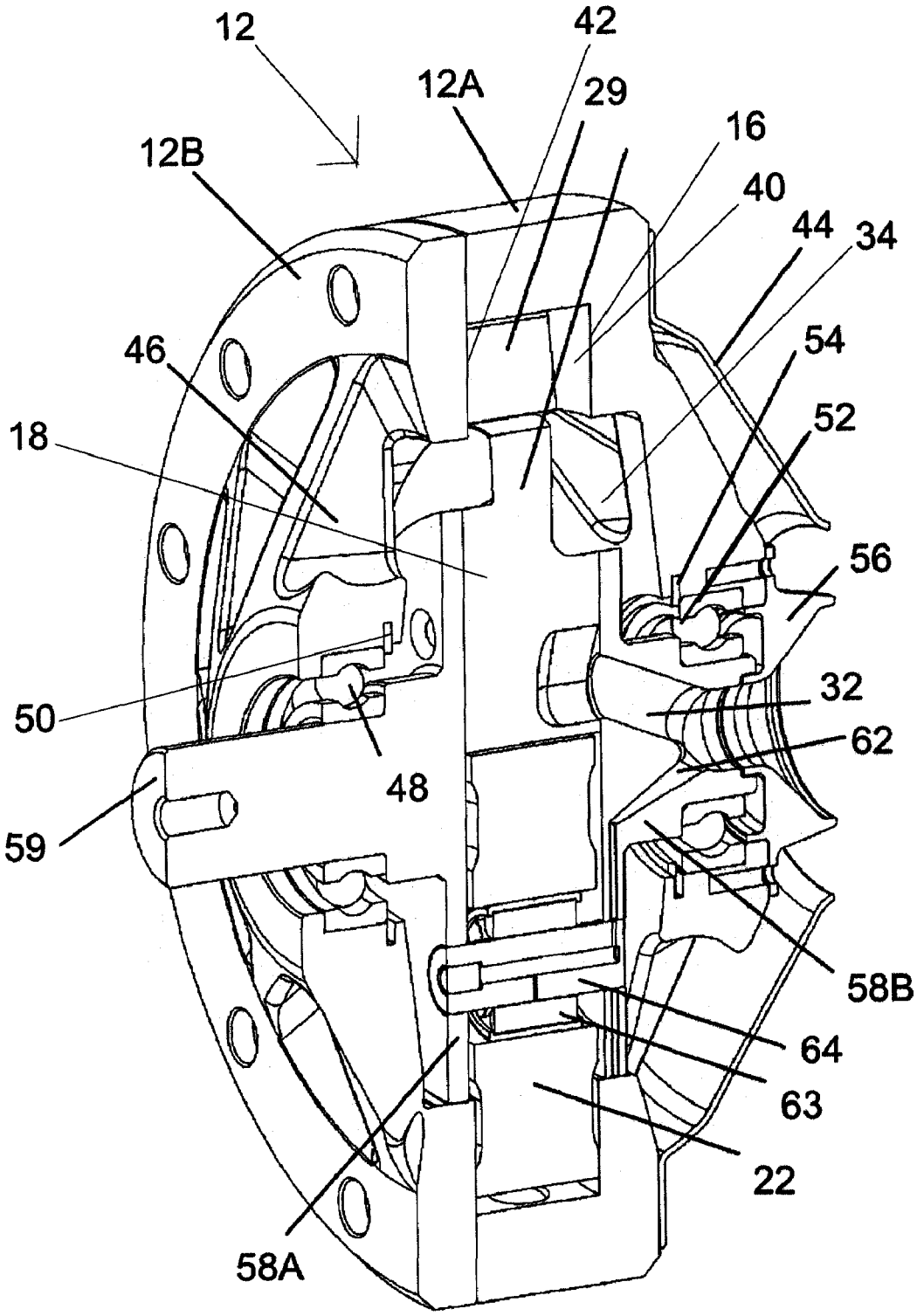
FIG. 2 is an isometric section view of the machine of FIG. 1 configured as an engine.

The outward projections 26 and inward projections 16 may be configured as shown for the pistons 25 and cylinder 29 geometry of FIG. 2 of the '221 publication, in which each outward projection 26 has a leg 26A and a foot 26B, such that foot 26B is wider than the leg 26A in the circumferential direction. This structure is shown in FIGS. 2-8E. Each foot 26B is rounded to increase the surface area of the seal area, as the outward projections 26 move into and out of the cylinders 29 formed by the inward projections 16. A high displacement device in accordance with the machine shown in FIG. 1 is possible, that, compared with the device shown in the '221 publication, avoids problems such as gyroscopic forces and centrifugal loading of outer rotor associated with the large spinning mass of the outer rotor in the '221 publication. An energy transfer machine 10 as shown in FIG. 1 may also have increased sealing capacity of the sealed chambers 28 (by eliminating the outer-rotor-to-casing leakage path of the device of the '221 publication) and may operate as an internal combustion engine with higher power capacity due to the higher compression and/or combustion pressure capability as opposed to the external combustion engine described in the '221 publication.

Center points 20 of the projections 26 define a circle having radius X, which is the effective radius of the inner rotor 22. Points 30, which correspond to the points of maximum outward position of the points 20 as the inner rotor 22 rotates within the stator 12, define a circle having radius R, which is the effective radius of the virtual circle that the inner rotor 22 rotates within. In general, R is greater than X. In addition, R/X=Ns/Nr. When R=2X, as shown in FIG. 1, the path of a point 20 as the inner rotor 22 rotates in the stator 12 in relation to the stator 12 is a straight line as discussed in the '221 publication. In the embodiment when R=2X, the projections 26 may seal against the projections 16 during both compression and expansion. When R is not 2X, the projections 26 may seal with the projections 16 during compression or expansion but not both. For example, when R:X is 4:1 the path of a point 20 follows an astroid path. Such a path may be suitable for an embodiment, such as in a pump, where the use of one way valves makes sealing in either expansion or compression unnecessary. In general, the points 20 define hypocycloids, which is the path followed by a point on a circle rolling within a larger circle. In practice, the configuration of the projections 26 may have various geometries depending on the application. Points on the outer periphery of the inner rotor 22 that are not coincident with the points 20 will have slightly different paths from a hypocycloid. The paths of these other points will, in part, determine the configuration of the inner surface 14 of the stator 12. Material may be added to the outer periphery of the inner rotor 22 for example for wear purposes, and as a consequence, an equivalent amount of material may need to be removed from the inner surface 14 of the stator 12.

As indicated above, points 20 trace a circle of radius X during rotation in relation to the axis B. In relation to the stator 12, the points 20 trace straight lines that pass through the axis A. The sides of the cylinders 29 are corresponding straight lines that lie along the paths traced by outer edges of the pistons 25. These sides are parallel to or nearly parallel to and offset from the straight line defined by the path of the center points 20.

Figure 3:
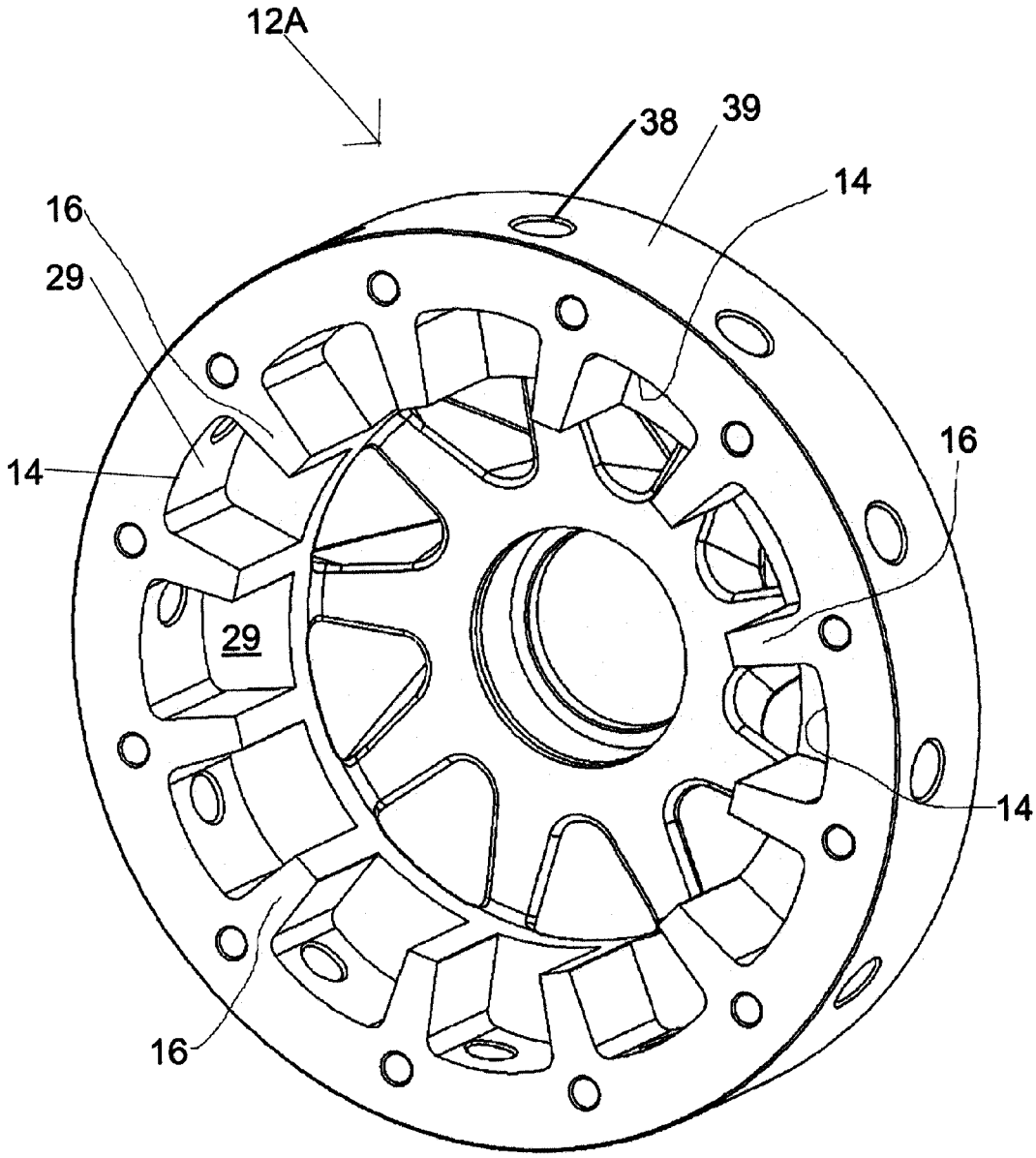
FIG. 3 is an isometric view of a stator for use with the machine of FIG. 2.

In one embodiment, an energy transfer machine 10 according to FIG. 1 configured as an engine has a single inner rotor 22 with half as many inner rotor pistons 25 as the outer stator 12 has cylinders 29. FIGS. 2-6 show an energy transfer machine 10 arranged as an internal combustion engine, with fluid transfer passages comprising a fuel intake conduit 32, an array of air intake conduits 34 and exhaust plenum 36 on the carrier 18. Holes 38, extending from the outer rim 39 of outer stator 12 to the inner facing surface 14, may be present such that ignition elements may be placed in each cylinder 29 through the holes 38 (FIG. 3). Various ignition elements may be used depending on the application, or in a diesel or detonation configuration, the ignition elements may be omitted. In one embodiment, the carrier 18 has an air intake side 41, shown for example in FIG. 6, and an exhaust side 43, shown for example in FIG. 5.

In FIG. 2, the outer stator 12 is formed of two pieces, a fixed casing 12A that includes the inward projections 16, and walls 40 of one side of the cylinders formed by the inward projections 16, and a casing cover plate 12B that forms the walls 42 on the opposite side of the cylinders to the walls 40. The fixed casing 12A is shown separately in FIG. 3. The casing cover plate 12B includes exhaust ports 46. An air intake shroud 44 is attached to the fixed casing 12A. An exhaust shroud (not shown) may also be used. The carrier 18 is mounted on a first set of bearings 48 secured within the fixed casing 12B by a retaining ring 50, and on a second set of bearings 52 secured within the fixed casing 12A by a retaining ring 54. Lubrication and seals for the bearings 48, 52 may also be provided. Also attached to the fixed casing 12A is a fuel intake shroud 56. There are various ways to build the carrier 18, rotor 22 and stator 12, using one or more pieces, such as using two end plates sandwiching a central ring to form the stator. The carrier 18 does not need to be axially precisely positioned. The inner rotor 22 may also float axially on its shaft. The relative thicknesses of the inner rotor 22 and stator 12 hold the inner rotor in its correct axial position.

Attached on respective opposite sides of the carrier 18 are carrier end plates 58A and 58B. Carrier end plate 58A, shown in a full side view in FIG. 4, includes an output shaft 59. Bolts (not shown) are placed in bolt holes 61 to fasten the carrier end plates 58A, 58B to the carrier 18. Carrier end plate 58B includes a centrifugal fuel conduit 60 (FIG. 6), which is a continuation of the fuel intake conduit 32 (FIG. 2). A branch 62 (FIG. 2) of the fuel conduit 60 may be directed to bearings 63 rolling on the shaft 64 forming the rotational axis B of the inner rotor 22 for cooling and lubrication. Alignment means, such as dowels, may be used to achieve precision assembly and for example allow alignment of the axes A and B.

Figure 5:
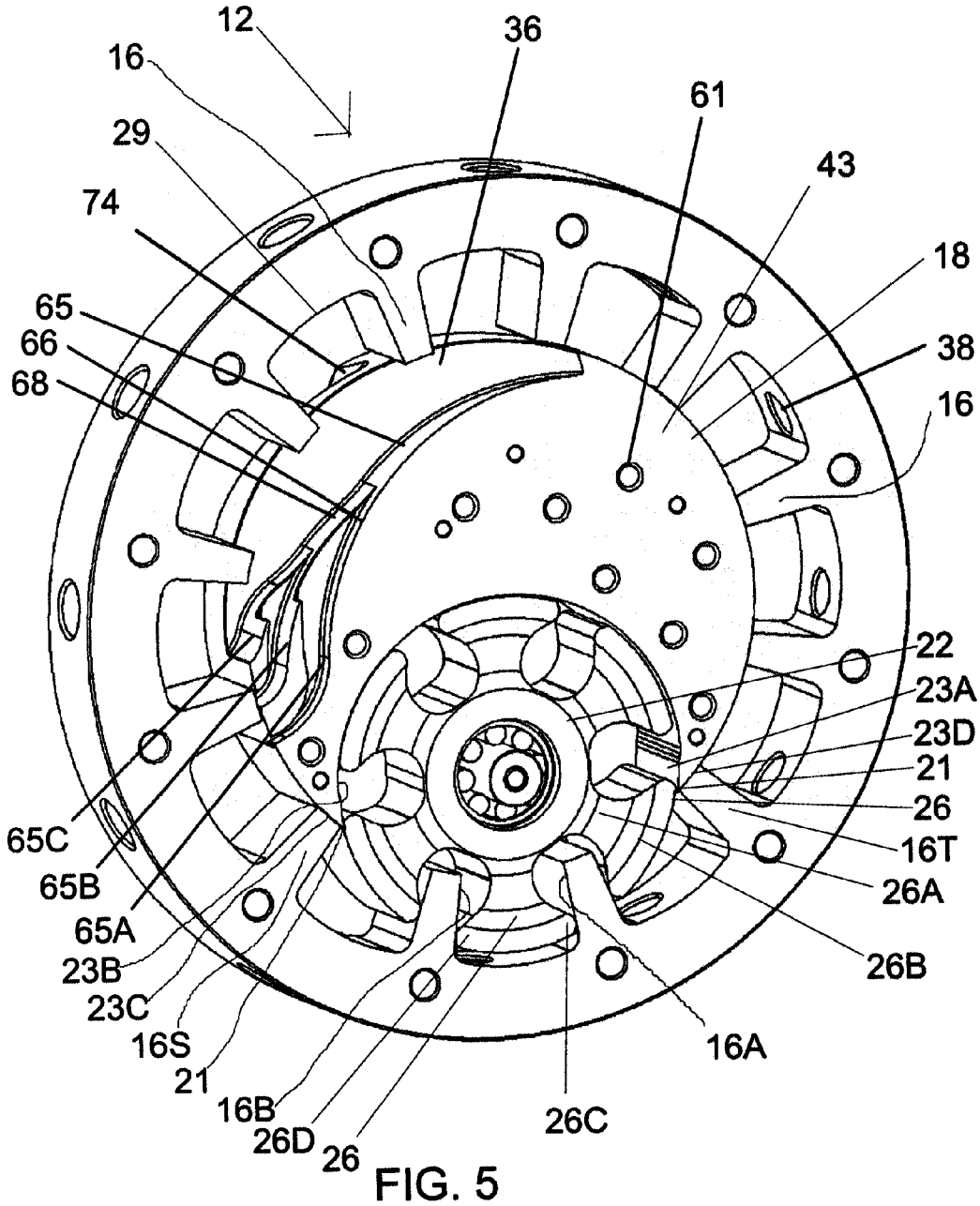
FIG. 5 is an isometric simplified view of the exhaust side of an inner assembly with carrier end plates removed in the machine of FIG. 2.

As shown in FIG. 5, the exhaust side 43 of the carrier 18 at least partially incorporates the exhaust plenum 36. In FIG. 5, the direction of rotation in normal operation of the energy machine is with the carrier 18 rotating counterclockwise as shown in the figure. A mirrored version of the device shown may be used for reverse rotation. The exhaust plenum 36 is at least partially bounded radially inward in the carrier 18 by a plenum surface 65 that, in a first portion 66 of the exhaust plenum 36, has generally increasing cross-section in the direction of exhaust flow. That is, as exhaust escapes the cylinders, the plenums have increasing cross-section in the direction of exhaust flow, which is opposite to the direction of rotation of the carrier in normal operation. Thus, the exhaust gases are vectored from radially inward to circumferential movement opposite to the direction of rotation of the carrier. A second portion 65B of the exhaust plenum 36 generally has increasing cross-section in the direction of exhaust flow. In one embodiment, the plenum surface 65 in the first portion of the exhaust plenum 36 has plural sections 65A, 65B, 65C, each section being staggered from each other section in the direction of rotation. Other numbers of cross-sections are possible, as many as may fit in the structure.

Figure 6:
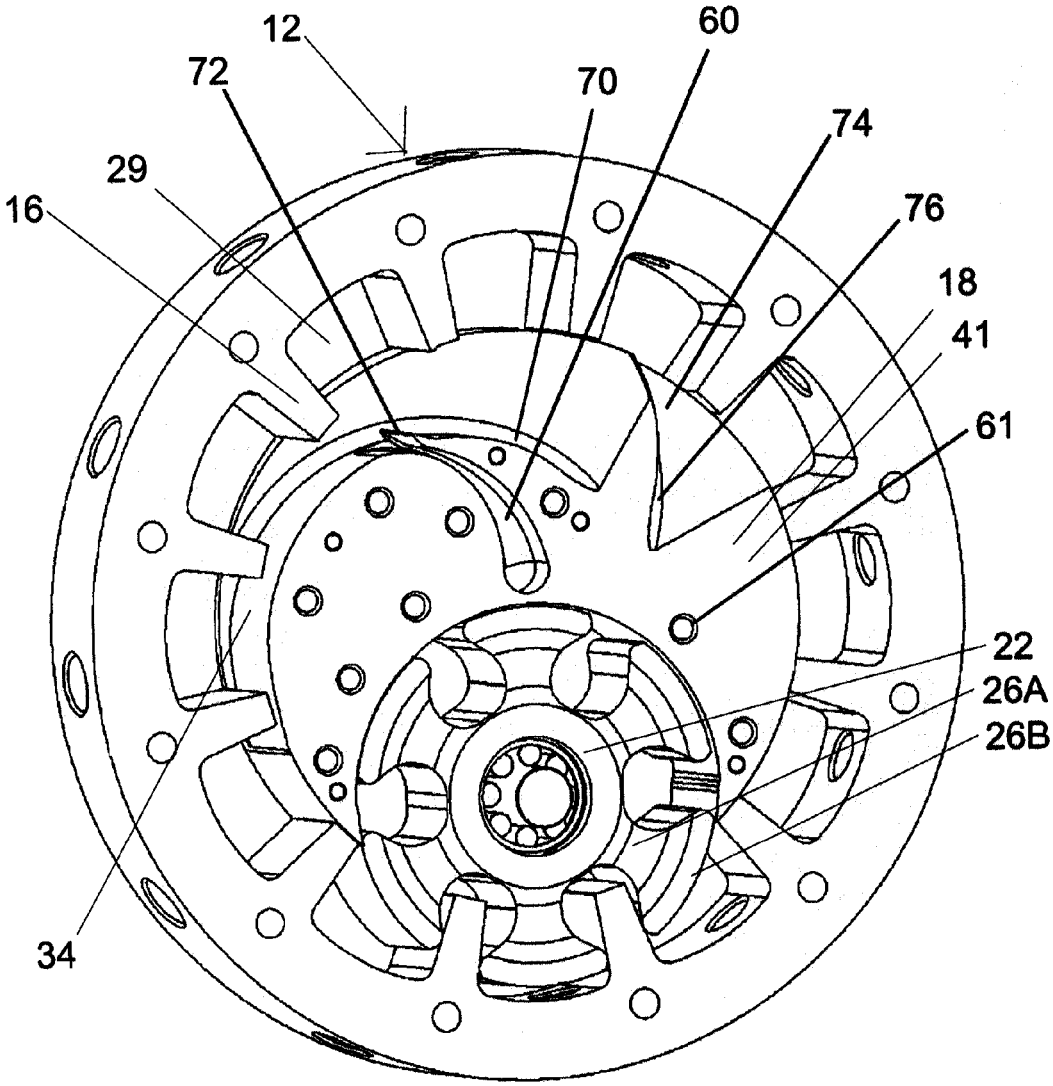
FIG. 6 is an isometric simplified view of the intake side of the assembly of FIG. 5.

On the air intake side, shown in FIG. 6, the air intake side of the carrier 18 at least partially incorporates the air intake conduit 34. In this figure, the carrier 18 has a direction of rotation in normal operation that is clockwise in the figure. The air intake conduit 34 is at least partially bounded radially inward in the carrier 18 by an air intake surface 70 that slopes within the carrier 18 so that the air intake conduit 34 has decreasing cross-section in the direction of air flow. Thus, air is vectored radially outward opposite to the direction of carrier rotation relative to the carrier. The fuel intake conduit 60 extends from an inner part of the carrier 18 into the air intake conduit 34. A flow enhancer such as lip 72 at for example the junction between the air intake conduit 34 and the fuel intake conduit 60 is provided on the carrier 18 to induce turbulence in fuel being fed into the variable volume chambers 28 and assist in drawing air-fuel mixture from the conduit 60 by creating a low pressure region adjacent the lip 72. The carrier 18 may also be provided with a fresh air scavenge conduit 74 located forward on the carrier 18 relative to the air intake conduit 34 in the direction of rotation of the carrier 18. The fresh air scavenge conduit 74 is at least partially bounded radially inward in the carrier 18 by a scavenge surface 76 that slopes within the carrier 18. The purpose of the fresh air scavenge is to displace or partially displace combustion gases. As shown in FIG. 6, in one embodiment, the air intake surface 70 slopes at a lower angle than the scavenge surface 76.

The engine shown is analogous to a two-stroke piston engine cycle, but without many of the drawbacks of a two-stroke piston system.

A single inner rotor 22 allows the engine to use much of the carrier rotation between the end of the expansion phase and the beginning of the compression phase to exhaust the combusted fuel/air mixture from the cylinders and to provide a fresh charge of air for scavenging air and/or providing air/fuel mixture to the cylinders. A single rotor also allows the engine to use much of the carrier rotation between the end of the expansion phase and the beginning of the combustion phase to cool the components which are heated by the combustion phase. An outer stator provides the advantage of a much lower leakage gap due to the elimination of the leakage gap between the spinning outer rotor and the casing of the device of publication '221. The air scavenge features may be used for example to allow decreased emissions of unburnt fuel.

Figure 4:
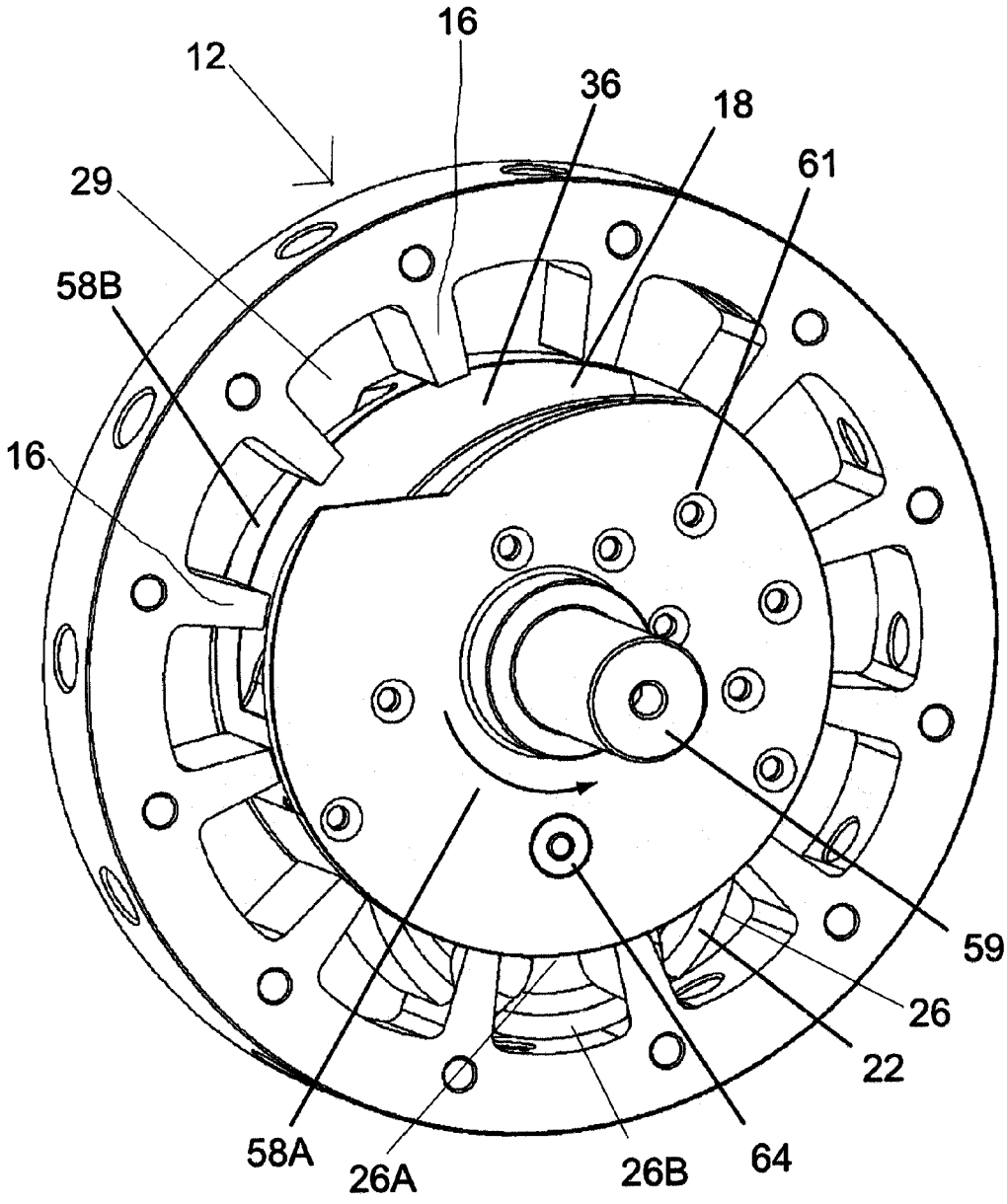
FIG. 4 is an isometric simplified view of an inner assembly for the machine of FIG. 2.

As shown in FIG. 5, for example, the projections 26 of the inner rotor 22 may each have a toe 26C and a heel 26D. The toe 26C and heel 26D in some embodiments are radiused as shown in FIG. 5. The radius provides for increased wear resistance of the toe 26C and heel 26D. Each toe 26C and heel 26D may be considered to be respective adjacent ones of the projections 26 illustrated in FIG. 1. That is, the foot 26B shown for example in FIG. 4 is made up of two cylindrical versions of the projections 26 of FIG. 1 joined together and connected with a single leg 26A to the remainder of inner rotor 22. Thus, the radius of one of the toes 26C or heels 26D functions in like manner to the radius of a projection 26 in FIG. 1. The sides 16A, 16B of the projections 16 in FIG. 4 follow the straight lines traced by the outer edges of the toe 26C and heel 26D respectively, these lines being offset and parallel or nearly parallel to the radial paths of the center points of the heel 26D and toe 26C. The sides 16A, 16B may be feathered, that is, cut-away slightly at their inner extremity to ease the transition of the pistons 26 in and out of the cylinders formed by the projections 16.

The ratio of R:X for the embodiment of FIGS. 2-6 is 2:1, which means that points on the rotor foot 26B lying a distance X from the axis of the inner rotor move in straight lines in relation to the stator 12. The sides 16A, 16B, of the projections 16 thus contact the toes 26C and heels 26D as the centers of the arcs of the toes 26C and heels 26D follow their straight paths that extend radially through the carrier axis A. The location of the sides 16A, 16B of the projections 16 that contact the toe 26C and heel 26D is established by the path traced by the outer surfaces of the toe 26C and heel 26D as the outer surfaces of the toe 26C and heel 26D maintain a close tolerance or contact seal with the sides 16A, 16B of the projections 16. In a multiple inner rotor configuration, as used for example in a pump, where the ratio R:X is greater than 2, the paths traced by points on the feet of the projections 26 will follow hypocycloid or near hypocycloid paths, but will be in any event defined by well known mathematics describing the paths of points on or inside a circle rolling inside another circle. These paths, modified to account for any material loss or addition for example for wear purposes, define the shape of the sides 16A, 16B of the projections 16.

A more detailed description of the operating principle/cycle of an embodiment of the engine is as follows. Air is drawn into the engine through the intake shroud 44 as a result of the reduction of air pressure caused by the air intake 34 of the spinning carrier 18. The fuel can be added to this incoming air in various ways such as by a venturi as in a conventional carburetor, or by a fuel injector in combination with an air throttle valve to control the incoming air volume and to maintain the correct fuel-to-air mixture ratio for proper ignition and combustion if a spark ignition combustion is desired. The fuel may also be drawn in through the centrifugal fuel conduit 60, which allows fresh air to be drawn in first, to scavenge the combusted air via the fresh air scavenge conduit 74. If detonation ignition is used, then the amount of fuel is controlled to produce the desired power output.

The air and/or air/fuel mixture is then centrifugally charged into the stationary cylinders 29 defined by the inward projections 16 of the stator 12. The exhaust plenum 36 preferably closes once all of the combusted gases are expelled (and possibly some of the fresh air) but before any of the unburned fuel/air mixture can be expelled. The wedging effect of the carrier air intake plenum 34 insures that the desired initial pressure of the stationary cylinders 29 is reached before compression. This may be below, at, or above atmospheric pressure, depending on the design requirements.

For a detonation engine, the compressed cylinder volume is preferably lower than the desired volume necessary for detonation combustion (that is, the compression ratio is higher than necessary to produce the heat required for ignition). The air intake 34 is then throttled slightly to achieve the desired compression ratio to achieve detonation at or near maximum compression. A computer may be used to throttle air coming into the engine to achieve optimum full compression pressure (and therefore temperature) at various operating speeds and conditions. In this way it should be possible to actively control the amount of air entering the engine (by the throttle valve), and therefore the final compression pressure so ideal detonation operating parameters can be achieved for a wide range of speeds and power output. An engine such as this would likely require a spark ignition at low speeds such as when starting and then switch over to detonation when the required speed (for sealing and aerodynamic compression) is achieved. A glow plug may also be used to initiate detonation in certain conditions.

Just before the mechanical compression by the inner rotor 22 phase begins, the carrier 18 seals the cylinder volume completely. Mechanical compression then begins when the tips of the inner rotor feet 26B enter the cylinders 29. Ignition takes place at or near maximum compression. A close tolerance seal should exist between the outer surface 24 of the inner rotor feet 26B and the inner surface of the carrier 18. Thus, rotor foot 26 should make a close tolerance seal with the surface 23A of the carrier 18 shown in FIG. 5. Surface 23A is a rectangular surface in this embodiment that extends around the inner surface of the carrier 18 just inside the tip 21 of the carrier part that holds the inner rotor 22. Improved performance is obtained with a sharp tip 21, as well as a sharp corresponding tip on the other side of the opening that receives the inner rotor 22 in the carrier 18. A close tolerance seal should also exist between the corresponding surface 23B on the other side of the opening that receives the inner rotor 22 in the carrier 18. Also, a close tolerance seal should exist between the tips of the projections 16 and the carrier outer surfaces 23C and 23D, which in FIG. 5 are shown with a close tolerance seal with projections 16S and 16T respectively. Clearance should be provided between the carrier 18 and stator 12 to reduce friction and ease assembly. On the other hand, the flat face of the side of the inner rotor 22 and the flat face of the stator 12 have a close tolerance fit, for example with less than 0.001 inches clearance combined on both sides, hence less than 0.0005 inches clearance on each side. Such flat surfaces may be achieved for example by grinding.

Air flow should be permitted around the projections 16 that extend into the pockets between rotor feet 26B or air flow should be provided between adjacent pockets on either side of a rotor foot 26B. Such features avoid compressive work or forces due to air compression in the pockets between the rotor feet 26B.

If a spark ignition is used, then a spark plug with some sort of timing means may be used. A more simple system would use a single electrode or conductor on the outer surface of each inner rotor foot 26B which comes into close proximity with two or more electrodes on the outer surface of the cylinders defined by the inward projections 16. In one embodiment, high voltage electricity is supplied to one of the stationary electrodes on the cylinder, causing it to arc to the inner rotor electrode (or conductor) and then to the other stationary electrode which is grounded. An array of stationary electrodes may be used which are wired separately and supplied with spark producing voltage with some of these separately wired electrodes coming into spark proximity sooner than others. In this way, it is possible to change the ignition timing by simply diverting voltage from one set to the next. This spark ignition may also be used to increase the pressure in the chamber enough to initiate detonation and thereby reducing or eliminating the possibility of pre-detonation. Varying voltage may also be used to vary timing by causing the spark to jump the gap between the stator and the inner rotor at various rotor positions. Other ignition means using an external energy source, rather than heat resulting from compressive energy, may be used, particularly ignition means that increase the ignition speed, as are now known or hereafter developed. To facilitate fast ignition at high engine speeds, a series of electrodes or other ignition devices could be arrayed circumferentially along the inner surface of the stator cylinders and activated at the same time or in a desired pattern, such as sequentially. The ignition devices in one embodiment initiate a spark from the stator surface through the compressed gas to the outer surface of the inner rotor for one or more of the ignition devices, thereby maximizing the flame front surface area and the speed of combustion.

When combustion takes place and expansion begins, the vector force of pressure pushing against the outward facing surface 24 of the inner rotor feet 26B, causes the carrier 18 to rotate via the force transferred to the inner rotor shaft 64 and bearings 63. This expansion force happens N times per carrier rotation, where N is the number of cylinders defined by the inward projections 16. N may be for example 12 as in the embodiment shown. The expansion force is constantly overlapping, and in the 12 cylinder example gives the engine a twelve stroke high torque operating principle. Greater or fewer pistons 25 and cylinders 29 may also be used.

When the expansion phase is complete, any elevated pressure gases are preferably exhausted gradually, or in stages, and vectored away from the rotation of the carrier 18 though the vectored expansion plenums 65A, 65B, 65C, to provide extra rotational energy to the carrier 18. The first stage expansion plenum 65A has a very small cross section to make maximum use of the high pressure as it is vectored away from the rotation of the carrier 18. This will also have the benefit of reducing the sound wave energy (which usually accompanies internal combustion engines where the valves or ports open much more suddenly) because this escaping pressure is gradually released instead of all at once. The second vectored expansion plenum 65B has a larger cross section for capturing energy from the lower pressure that still remains after the first stage pressure drop and to insure that the pressure is reduced significantly before the combusted gases enter last vectored plenum. The last vectored expansion plenum 65C is intended to capture remaining pressure energy if pressure still exists in the cylinder.

The depressurized gas is vectored axially by the exhaust plenum 65 toward the exhaust ports 46 and replaced with fresh air from the fresh air scavenge conduit 74 and the cycle is repeated.

Lubrication may be accomplished by the use of a common two-stroke fuel lubrication additive. For lower emissions, the use of a fuel such as a high lubricity diesel may provide enough lubrication on the compression side even though all of the fuel may be combusted on the expansion side. This is due to the fact that the compression phase pistons determine the position of the less lubricated expansion phase pistons. In addition, the cylinder walls which are radially inward from the expanding chamber, which are sealed from the combustion temperature and flame, should provide lubrication for the advancing (radially inward) pistons 25 contact.

Using detonation combustion intentionally is a problem for piston engines because the highest pressure phase, where detonation would occur, has a relatively long dwell time and so the detonated air/fuel mixture has a relatively long time where the increased pressure and temperature can cause damage to the pistons and cylinders. The disclosed engine, on the other hand, does not have this same sinusoidal compression/expansion profile and so the pistons 25 spend only a small fraction of the time at full compression where detonation could cause damage. Advantages of detonation combustion are believed to include higher power, lower emissions and higher efficiency.

Another embodiment of the energy transfer machine 10 shown in FIG. 1 is for use as a compressor or vacuum pump. The device in this embodiment may have less than half as many "pistons 25" on the inner rotor/s 22 as "cylinders 29" on the outer stator 12. An example of a compressor or pump is shown in FIGS. 7-10. The geometry of the inner rotor 22 and carrier 18 of the pump 80 of FIGS. 7-10 is the same as the corresponding parts of the pump of FIGS. 15 and 17 in the '221 publication. Unlike the device of the '221 publication, the pump 80 of FIGS. 7-10 uses a fixed outer stator 12.

A device according to FIG. 1 may be used as a vacuum pump if gas is drawn into the center casing volume and expelled through one way valves in each cylinder as the inner rotor seals and compresses this gas to a higher pressure than is on the outside of the one way valves. The pump may be used as a compressive or non-compressive pump. In a pump embodiment, the output shaft of the carrier becomes a drive input.

Figure 7:
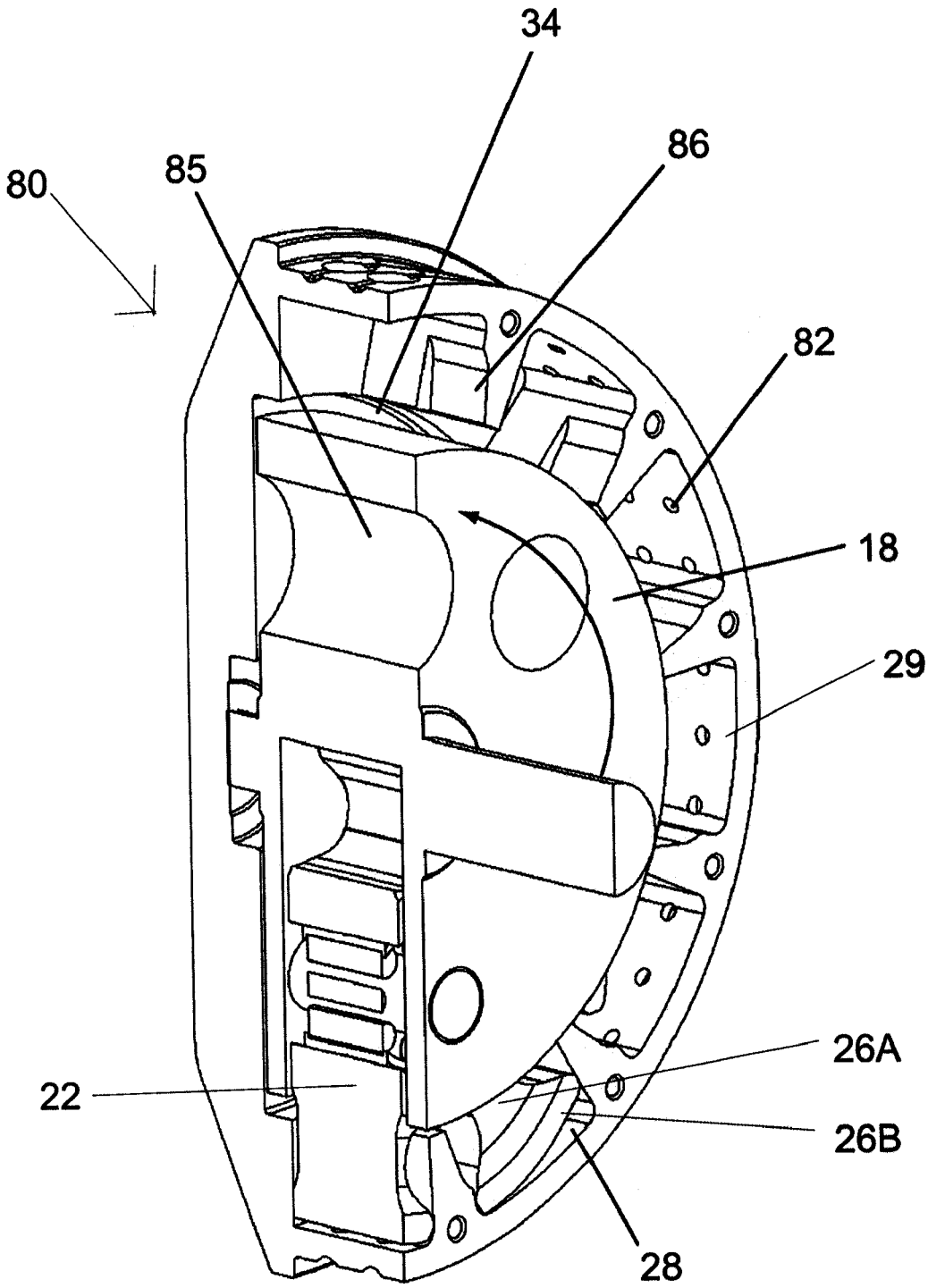
FIG. 7 is an isometric section view of the machine of FIG. 1 configured as a pump.
Figure 9:
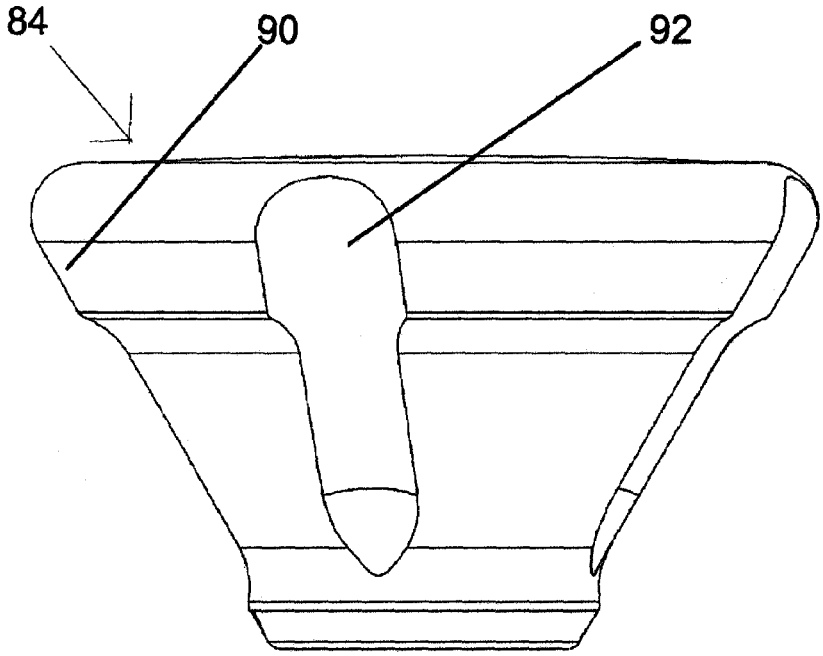
FIG. 9 is a side view of a plug for use in the machine of FIG. 7.

Shown in FIG. 7 is a simple but effective embodiment of a vacuum pump 80. As mentioned in the spherical piston 25 example of FIG. 1, each cylinder 29 defined by inward projections 16 has some type of one way valve as for example valves 82 which allows the pistons 25, defined by outward projections 26, to push gases out of the cylinders 29 but does not allow the gases to flow back in. The one way valves 82 may be tapered plugs 84 as shown in FIG. 9, or they may be reed valves or a single molded band, possibly with tapered or other-shaped protrusions or other suitable valves. Tapered plugs of some sort, whether individual plugs or multiple plugs molded as one piece to a flexible band or spring, are preferable because they allow a very low final compression volume, by filling the volume between the inner and outer surfaces of the stator and therefore providing high vacuum pressure or high compression pressure.

The embodiment of FIGS. 7-10 may also be used as a compressor if an additional elevated pressure plenum is provided around the outside of the cylinders 29 to contain the air which is pushed past the valves (not shown in the drawings).

An important feature of this vacuum pump 80 (or compressor) design is a system of relief cuts or channels 86 which allow air to fill the expanding sealed chamber between each inner rotor foot 26B and cylinder 29 after each compression phase (12/carrier revolution in these examples) is complete. Balance bores 85 may be drilled in carrier 18 to offset weight distribution and/or reduce the overall weight of the unit.

The example of FIG. 8 is shown with a single inner rotor 22, but multiple inner rotors 22 (or other piston/cylinder geometries or numbers) may also be used.

Figure 8A:
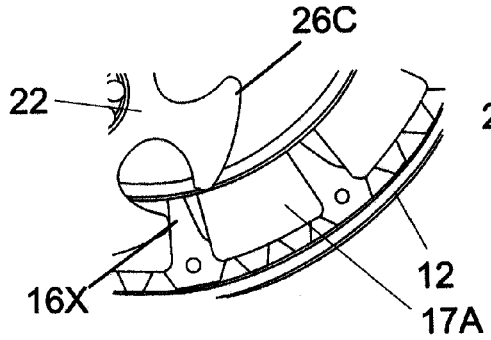
FIGS. 8A-8E are a sequence of views showing operation of the machine of FIG. 7.
Figure 8B:
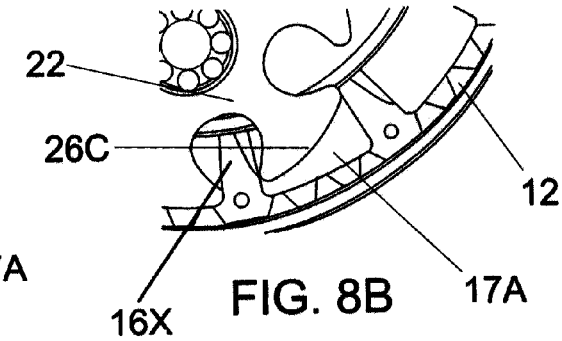
Figure 8C:
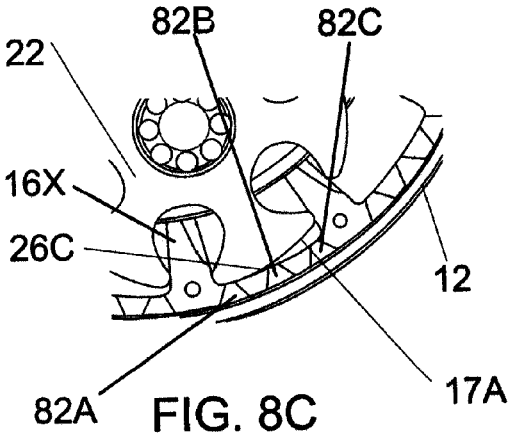
Figure 8D:
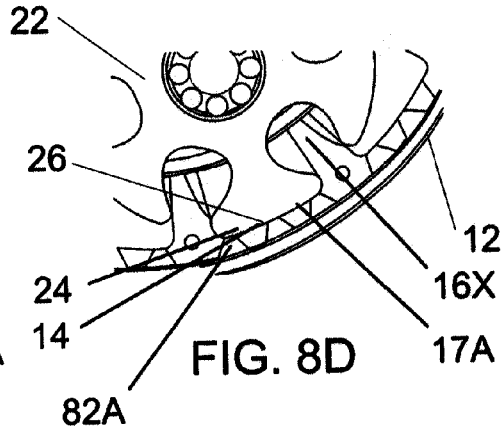
Figure 8E:
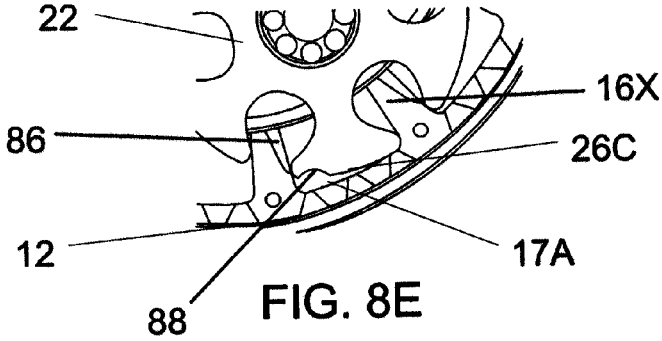

In FIG. 8A, inward projection 26C is about to enter chamber 17A defined by outward projections 16X. The projections 16X include the elements shown and the material forming the sidewalls of the chamber 17A. The carrier 18 may seal the cylinder chamber 17A before mechanical compression begins. In FIG. 8B, mechanical compression begins in chamber 17A as the leading edges and trailing edges of the projection 26C seal against the cylinder walls. In FIG. 8C, which shows the first part of the compression cycle, all three one way valves 82A, 82B, and 82C are available to expel pressurized gas. In FIG. 8D, the seal between the outward surface 24 of the inner rotor 22 and the inward surface 14 of the stator 12 moves across the chamber 17A in the direction of movement of the carrier 18. The seal in this case may for example be a contact or close tolerance seal or overlapping seal, such as a labyrinth seal. As the seal moves across the chamber 17A, each of the valves allows gas to escape. The final volume at this position can be extremely low. As little as 1/400th of the initial volume has been predicted by computer models which allows for very low vacuum pressure or high compression pressure. In FIG. 8E, cut-outs 86 in the cylinder wall (and/or could be in the piston 25 wall) allow gas to fill the expanding chamber 17A after compression is complete. A small pocket 88 in the foot 26C allows the trailing expansion volume to increase with a reduced vacuum spike. An embodiment with multiple rotors may eliminate or reduce air flow features such as cut-outs 86, 88 due to its inherent characteristic of unsealing during only one of the entry or exit of the foot into a cylinder. The valves 82 my also be located in the sidewalls of the chambers 17A.

Figure 8F:
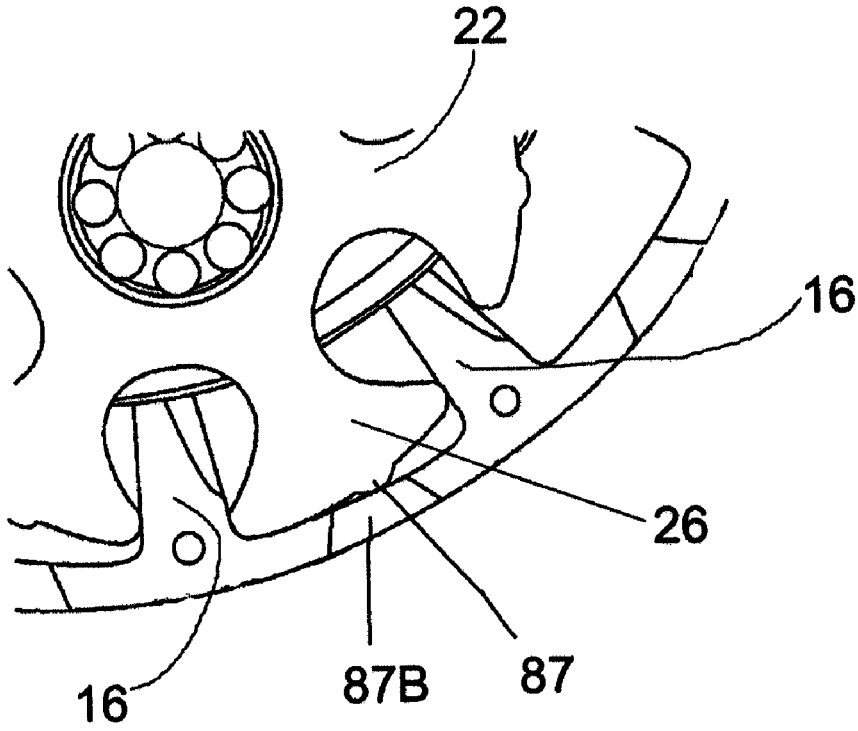
FIGS. 8F and 8G are views of energy transfer machines with features to allow use of the machines as expanders.
Figure 8G:
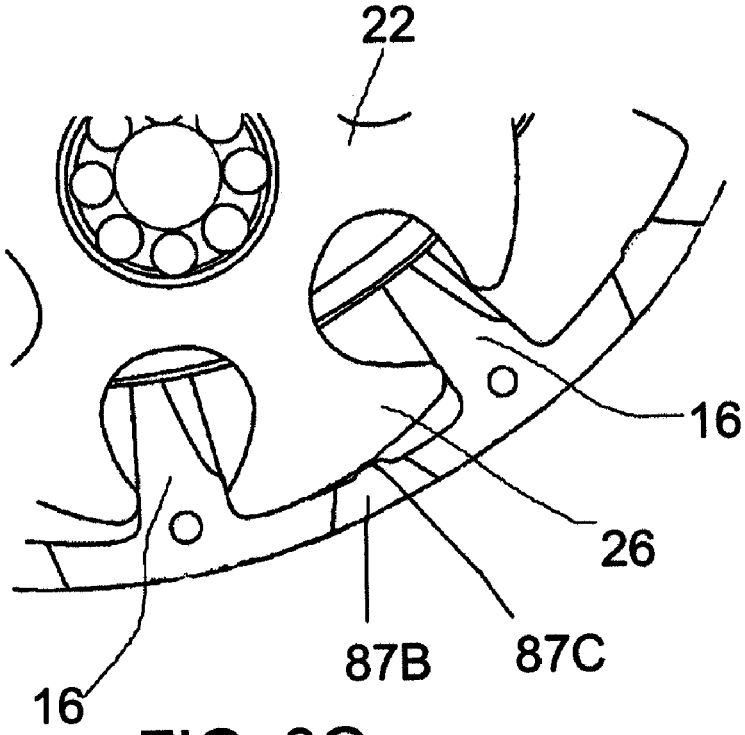

In an expander configuration, two of which are shown in FIGS. 8F and 8G, a feature is provided to cause inlet valves 87B to open. In the example of FIG. 8F, the feature is a bump 87 on the outer surface of the projection 26, while in the example of FIG. 8G, the feature is a bump 87C on the valve 87B. The valves 87B may otherwise be designed as valves 84. The features 87, 87C cause the valves 87*b* to open by mechanical pushing when the rotor is at or near full compression.

Figure 10:
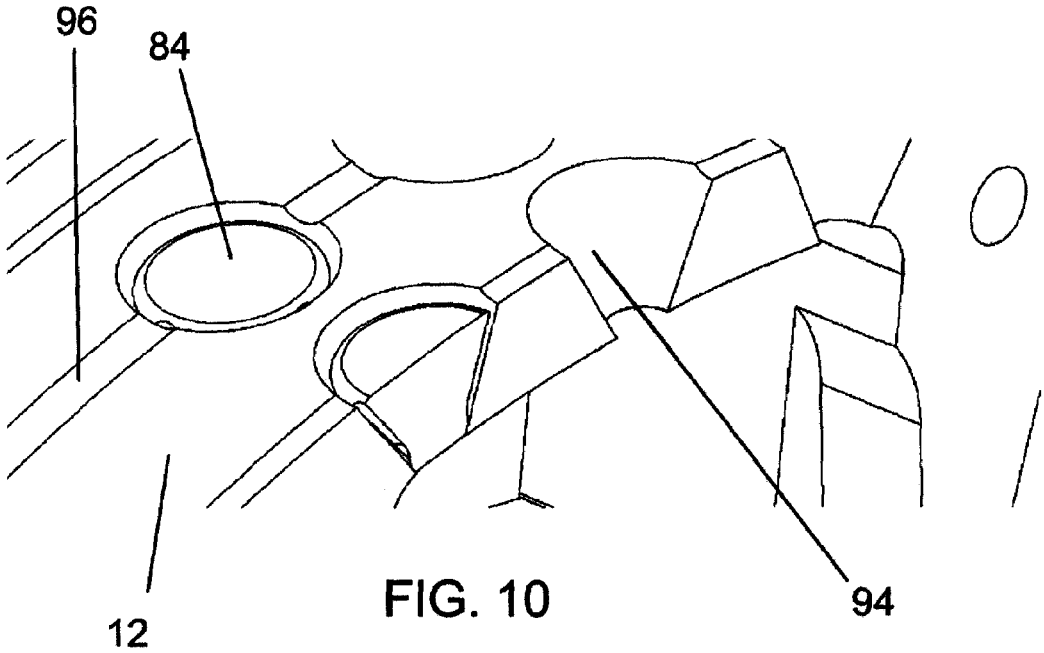
FIG. 10 is an isometric view, partly in section, showing plugs of FIG. 9 installed.

FIG. 9 shows a tapered plug 84. Tapered outer edge 90 positions the plug in a tapered bore in the outer stator 12. Relief cuts 92 allow pressure to equalize on all surfaces up to the seal face. On the narrower side of the plug 84, the taper is relieved to prevent higher pressure expelled air from creating too much sealing force as a result of increased surface area. The tapered plug 84 may be a separate part from a device used to hold the plug 84 in place, such as an elastic or spring means, and it may be molded as one part with such a device. As shown in FIG. 10, plugs 84 are shown in tapered bores 94 in the outer stator 12. A groove 96 may be provided in the tapered bore 94 for receiving an o-ring or spring or other resilient retainer device.

It is possible to completely eliminate the contact between pistons 25 and cylinders 29 (and thereby allow the use of non-lubricating fuels or gases) if the inner rotor/s 22 is/are geared to a fixed stator. The fixed stator gear is coaxial with the carrier rotational axis. In this case, the inner rotor is preferably fixed to a shaft which has a gear fixed to it inside a sealed, lubricated, chamber which rotates as an integrated part of the carrier. One or preferably two idler gears between the inner rotor/s gear transmits force to (or from) the fixed gear. In actuality, when the inner rotor geometry of FIG. 2 is used, there is very little force which must be transmitted through the gears, but higher speeds and pressures may be possible with this configuration with lower wear and reduced need for exotic materials for the pistons 25 and cylinders.

The use of different radii on the leading and trailing tips of the inner rotor feet 26B provides advantages. Different radii have the effect of changing the rotation force on the inner rotor 22 which is caused by the pressure of the compressing and or expanding gases. Different leading and trailing tip radii may be selected, tested and optimized to minimize the rotational force of the inner rotor 22 relative to the cylinders 29. A larger radius on one tip will generally result in a greater force (due to pressure) away from the larger radius tip (that is, rotationally in the direction of the smaller radius tip) as a result of a larger surface area affecting rotation of the inner rotor which the pressure is acting on.

Figure 11:
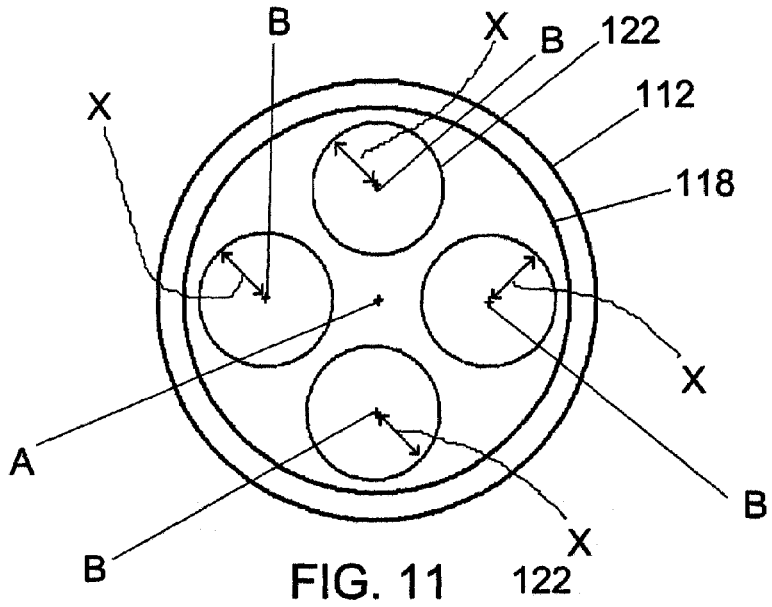
FIG. 11 illustrates a four inner rotor embodiment of an energy transfer machine.

FIG. 11 shows schematically an embodiment of an energy transfer machine with a stator 112 containing an inner carrier 118 rotating about an axis A. Four identical inner rotors 122 rotate about respective axes B that are parallel to axis A. An embodiment with 2 or more inner rotors 122 has the advantage that it can be more readily balanced with respect to inertial loads and forces exerted by the fluid pressure in the cylinders. R in this case is equal to AB, the distance from A to B, plus 2X. If the ratio of R:X is not equal to 2 then the points on the inner rotors 122 will not follow straight lines, and the pistons of the inner rotors 122 can seal with the cylinders on the stator 112 only during one of compression and expansion and not both. For example, if AB equals 2X (that is, each rotor lies a distance X from the center axis A), then R:X=3 and each inner rotor 122 will rotate three times while the carrier 118 rotates once within the stator 112.

Figure 12:
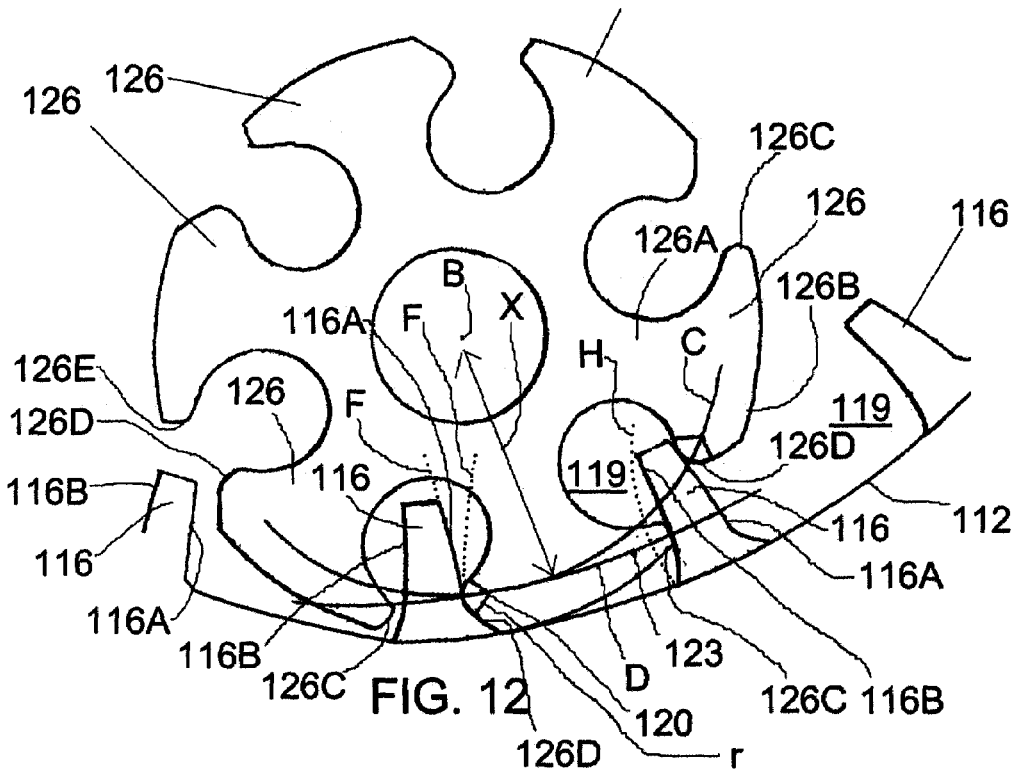
FIG. 12 shows an inner rotor and construction principles for use as the inner rotors of FIG. 11.

FIG. 12 shows an embodiment of an inner rotor 122 that may be used in the energy transfer machine of FIG. 11. The inner rotor 122 has six projections 126 rotating about axis B. Each projection 126 is formed from a foot 126B and a leg 126A. Each foot 126B has a toe 126C and heel 126D. Each heel 126D has an outer surface that is defined by a radius r about a point 120. As the point 120 rotates about the inner rotor axis B, it traces out a path C in the inner rotor frame of reference, and a hypocycloid path in relation to the stator 112, namely the path followed by a point on a circle rotating inside a large circle. The large circle in this case is a virtual circle part of which is shown by the arc D in FIG. 12. The exact equation for the path is well known mathematics and depends on the ratio R:X. Each point on the outer surface of the heel 126D thus traces a path that is offset from the path of the point 120 by an amount equal to the radius r. The path thus traced by the outer surface of the heel 126D is the position of the surface 116A of the projection 116 adjacent the heel 126D. In this manner, the heel 126D may maintain contact or sealing proximity with the adjacent projection 116 as it enters a cylinder 119 formed between two consecutive projections 116. The path traced by points on the heel 126D that contact the surface 116A is shown as line F. Additional material may be added to the base of the foot 126B to fill in the cylinder 119 when the projection 126 is at its deepest position in the cylinder 119.

For the toe 126C, slightly different considerations apply. A point 123 in the toe 126C lies outside the circle C. This point 123 follows a slightly modified hypocycloid path. This path is defined by the path of a point outside of a circle that rotates in a larger circle. The path has the shape shown for the surface 116B of each projection 116 and again is defined by known mathematics. The location of the surface 116B is offset perpendicularly from the path actually traced by the point 123 by an amount equal to the radius of the toe 126C, which radius is centered on the point 123. In one embodiment, the radius of the heel 126D is not equal to the radius of the toe 126C. The path of a point 126E at the extremity of the toe 126C is shown by the surface 116B and path H. Path H shows the path of the point 126C as it exits the cylinder 119. The maximum height of the projection 116 is thus determined by the need for the toe 126C to clear the projection 116. In this manner, the toe 126C may maintain contact or sealing proximity with the cylinder wall 116B during a compression stroke as the foot 126B enters the cylinder 119, but loses contact or sealing proximity with the cylinder wall 116B as the foot 126B exits the cylinder 119.

Thus, in the inner rotor 122, with R not equal to 2X, the foot 126B maintains contact or sealing proximity with the cylinder walls 116A and 116B as it enters the cylinder 119, and loses contact with the cylinder walls 116A and 116B as it exits the cylinder 119. For this reason, cut-outs 86, 88 as shown in FIG. 8E are not required if R is not equal to 2X. The embodiment of FIGS. 11 and 12 is useful for a pump, vacuum pump or compressor used with one-way valves illustrated in relation to FIGS. 7-10.

Figure 13:
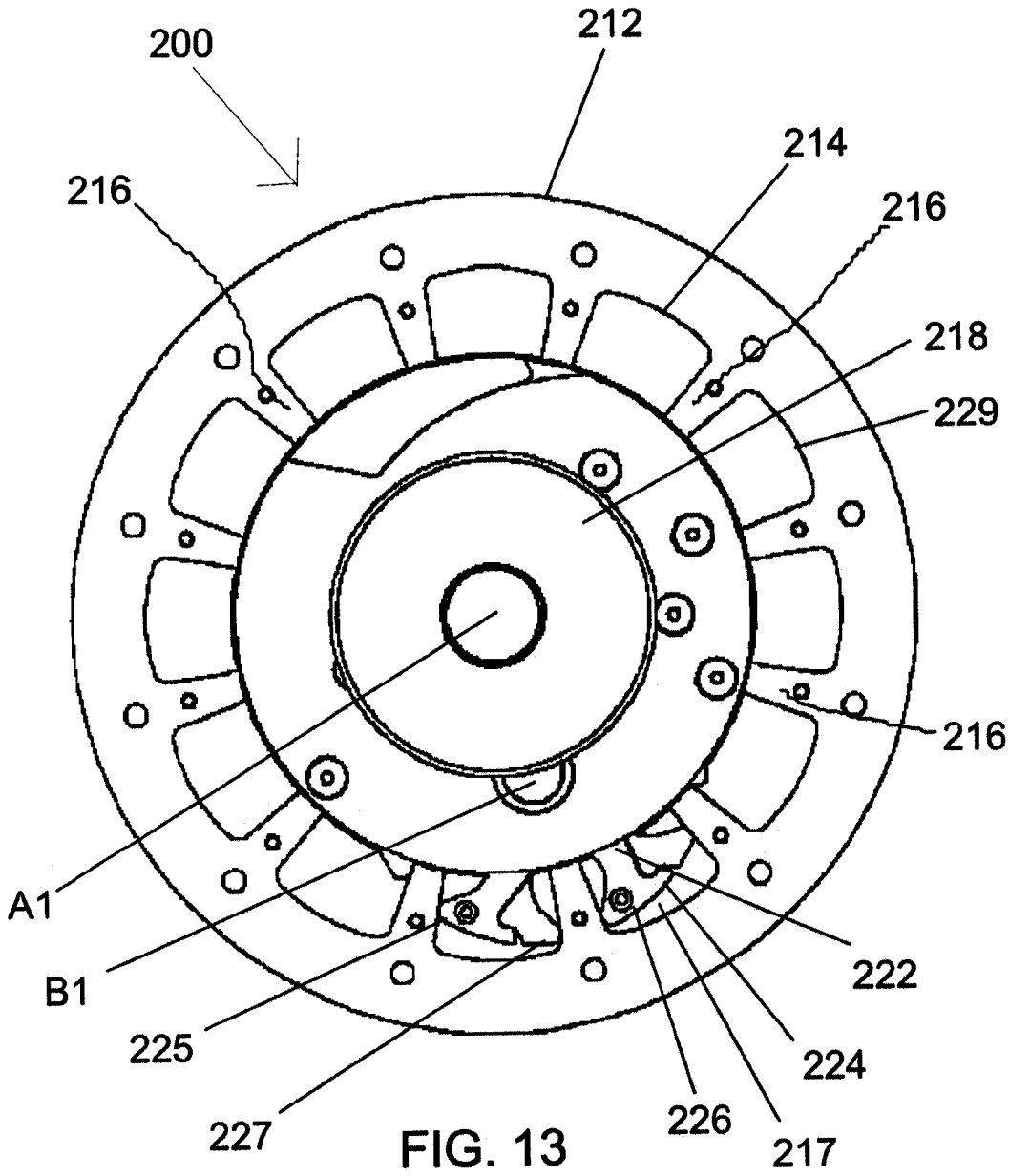
FIG. 13 is a front view of a device with an inner rotor having expandable outward projections.

Referring to FIG. 13, there is shown an energy transfer machine 200, with an outer housing 212 having an inward facing surface 214 and inward projections 216 arranged around the inward facing surface 214. The inward projections 216 define cylinders 229. A carrier 218 is secured for rotation at least partly within the outer housing 212 about an axis A1. An inner rotor 222 is secured for rotation about an axis B1 within the carrier 218. The inner rotor 222 has an outward facing surface 224 and outward projections 226 arranged around the outward facing surface 224. The inward projections 216 project inward and the outward projections 226 project outward to mesh with each other and define variable volume chambers 217 between the inward projections 216 and the outward projections 226, as the inner rotor 222 rotates within the carrier 218. The outward projections 226 each have a leading edge 225 and trailing edge 227. The outward projections 226 are circumferentially expandable under inward radial fluid pressure to bias the leading edges 225 and trailing edges 227 of the outward projections 226 into continuous sealing contact with the inward projections 216 of the outer housing 212 as the inward projections 216 and outward projections 226 mesh with each other. Fluid transfer passages, such as described above in relation to the engine and pump embodiments shown in FIGS. 2 and 7 respectively, are provided on at least one of the outer housing 212 and carrier 218 to permit flow of fluid into and out of the variable volume chambers 217.

The device of FIG. 13 may operate as a rotor or gear for various devices such as a rotary compressor, expander, engine or pump device. The projections 226 of the device of FIG. 13, which function as pistons, expand in the circumferential direction between the sealing engagement surfaces of the leading edge 225 and trailing edge 227 of each projection 226.

Figure 14:
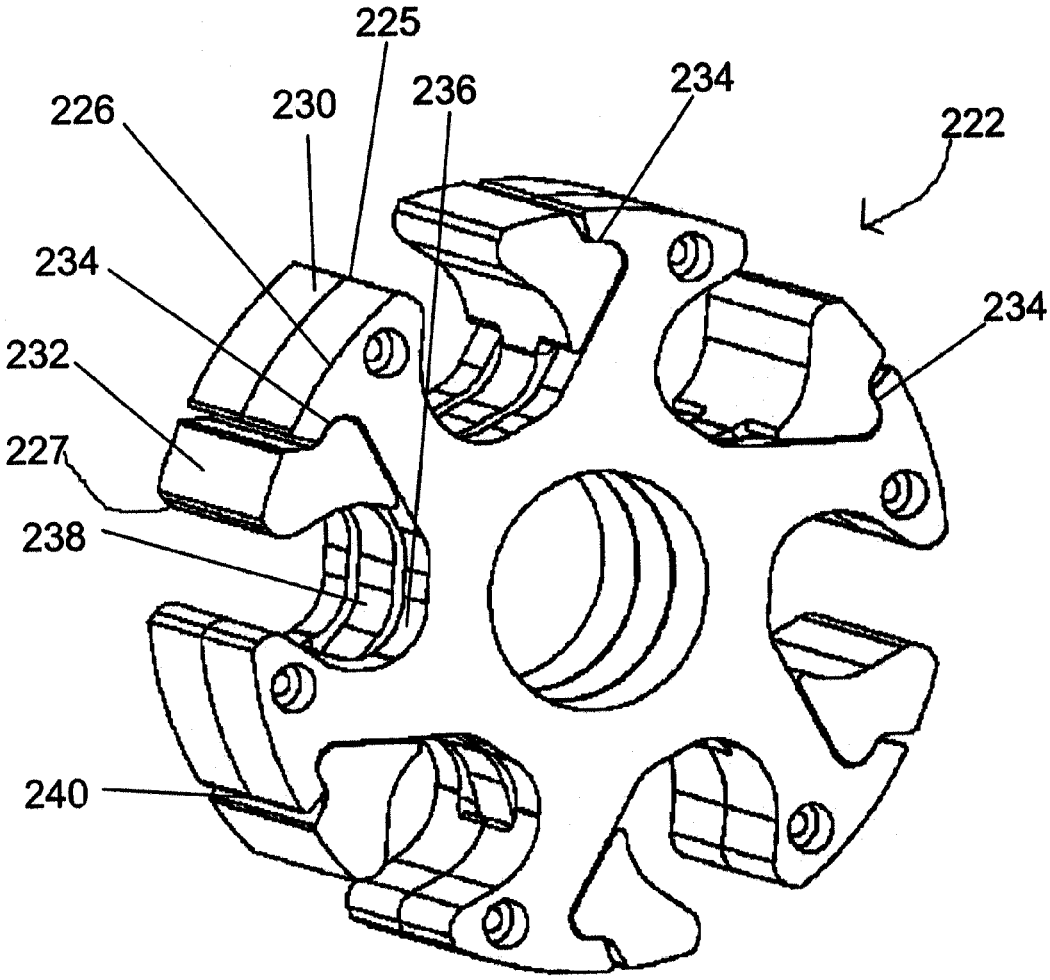
FIG. 14 is an isometric view of the rotor of FIG. 13.

As shown in FIG. 14, each outward projection 226 may be formed from a primary foot 230 and secondary foot 232 supported for circumferential movement relative to each other, with each primary foot 230 abutting the corresponding secondary foot 232 along a circumferentially extending sealing surface 234. Also as shown in FIG. 14, the primary feet 230 of the inner rotor 222 may be mounted on at least a first plate 236 that extends radially from the axis of the inner rotor 222, and the secondary feet 232 of the inner rotor 222 may be mounted on at least a second plate 238 that extends radially from the axis of the inner rotor 222. In this manner, the first plate 236 and the second plate 238 rotate independently to each other about the axis of the inner rotor 222. The independent rotation is permitted over an angle sufficient to provide continuous sealing contact of the leading edges 225 and trailing edges 227 of the outward projections 226 with the inward projections 216 of the outer housing 212, as well as sealing contact along the seal 234.

Thus, as in the embodiment shown in FIG. 14, the leading edges 225 of all projections 226 rotate around the rotor rotational axis as a one piece member, and the trailing edges 227 of all projections are able to rotate with to the plate 238 around the rotor rotational axis as a one piece member. The sealing engagement surfaces of the leading edge 225 of all projections 226 may be of one piece construction (or as an assembly which moves as one piece) and the sealing engagement surfaces of the trailing edge 227 of all projections 226 may be of one piece construction (or as an assembly which moves as one piece).

An advantage of this rotor construction of FIGS. 13 and 14 (for an application such as, but not limited to, an inner rotor of a compression device) is that the projections 226 can expand in the circumferential direction to account for wear and/or manufacturing inaccuracy without allowing individual projections 226 to expand while they are not in contacting engagement with the other stationary or rotary sealing member (such as, but not limited to, the outer rotor of a compression device or an outer fixed member of a compression device). Thus, this embodiment of FIGS. 13 and 14 has applicability to the designs shown in FIGS. 1-12 of this disclosure.

The embodiment of FIG. 13 is shown in simplified form (with front cover and other components removed) with an inner rotor 222 of an assembly where the mating sealing member of the outer stator 212 is stationary and the inner rotor 222 is rotating on a shaft which is attached to the rotating inner rotor carrier 218. The inner rotor design of FIGS. 13 and 14 may also be used in a configuration with multiple inner rotors.

A spring or springs may be used to provide the initial angular movement/force of the leading contact surfaces of the first plate 236 relative to the trailing contact surfaces of the second plate 238. The surface area 240, which is a gap extending from the outer surface of the projection 226 to the sealing surface 234 (and thus lies between the two expanding members 230, 232 of each projection 226) is preferably large enough to use the pressure of the compressed gasses and/or liquid to provide additional contact force to seal the leading and trailing contact surfaces 225, 227 of the projections 226, respectively, against the mating contact surfaces of the mating sealing member of the outer stator 212. Pressure on the surface area 240, plus any other forces tending to force the two members 230, 232 apart, must exceed the sum of opposing forces tending force the two members together, such as pressure on the contact surfaces 225 and 227. Many other applications also exist for internal and external gear pumps and compressors and other types of positive displacement devices.

In one embodiment, several energy transfer machines as described may have their outputs coupled together for increased power.

In the claims, the word "comprising" is used in its inclusive sense and does not exclude other elements being present. The indefinite article "a" before a claim feature does not exclude more than one of the feature being present.

The various features of the energy transfer machine shown and its various embodiments described in this provisional patent application may operate with or without many of these features. The above description is only intended to describe exemplary embodiments. Other variations of the energy transfer machine are possible and are intended to be covered by the claims that follow.

Immaterial modifications may be made to the embodiments described here without departing from what is covered by the claims.

What is claimed is:

1. An energy transfer machine, comprising:

an outer stator having inward projections;

a carrier secured for rotation at least partly within the outer stator;

at least one inner rotor secured for rotation about an axis within the carrier, the inner rotor having outward projections;

the inward projections projecting inward and the outward projections projecting outward to mesh with each other and define variable volume chambers between the inward projections and the outward projections as the inner rotor rotates within the carrier; and fluid transfer passages on at least one of the outer stator and carrier to permit flow of fluid into and out of the variable volume chambers, said fluid transfer passages comprising a fuel intake conduit and exhaust plenum on the carrier;

wherein said energy transfer machine is arranged as an internal combustion engine.

2. The energy transfer machine of claim 1 further comprising an air intake conduit in the carrier.

3. The energy transfer machine of claim 2 in which the carrier has an air intake side and an exhaust side.

4. The energy transfer machine of claim 2 in which:

the carrier has a direction of rotation in normal operation; and the air intake conduit has decreasing cross-section in the direction of air flow.

5. The energy transfer machine of claim 2 in which the fuel intake conduit extends from an inner part of the carrier into the air intake conduit.

6. The energy transfer machine of claim 5 in which a flow enhancer is provided on the carrier to enhance flow of fuel being fed into the variable volume chambers.

7. The energy transfer machine of claim 6 in which the flow enhancer generates a region of low gas pressure.

8. The energy transfer machine of claim 7 in which the flow enhancer is located at a junction between the air intake conduit and the fuel intake conduit.

9. The energy transfer machine of claim 2 in which the carrier has a direction of rotation in normal operation, and the energy transfer machine further comprising a fresh air scavenge conduit located forward on the carrier relative to the air intake conduit in the direction of rotation of the carrier.

10. The energy transfer machine of claim 1 further comprising ignition elements arranged around the outer stator.

11. The energy transfer machine of claim 1 in which each outward projection is provided with a leg and terminates in a foot connected to the leg.

12. The energy transfer machine of claim 1 in which the inner rotor has an effective radius X and rotates within a virtual circle having effective radius R, where R=2X.

13. The energy transfer machine of claim 1 in which the inner rotor has an effective radius X and rotates within a virtual circle having effective radius R, where R is not equal to 2X.

14. The energy transfer machine of claim 1 in which the ratio of the number of inward projections to the number of outward projections that mesh with each other to define variable volume chambers is 2:1.

15. The energy transfer machine of claim 14 further comprising an air intake conduit in the carrier.

16. The energy transfer machine of claim 15 in which the carrier has an air intake side and an exhaust side.

17. The energy transfer machine of claim 15 in which:

the carrier has a direction of rotation in normal operation; and the air intake conduit has decreasing cross-section in the direction of air flow.

18. The energy transfer machine of claim 15 in which the fuel intake conduit extends from an inner part of the carrier into the air intake conduit.

19. The energy transfer machine of claim 18 in which a flow enhancer is provided on the carrier to enhance flow of fuel being fed into the variable volume chambers.

20. The energy transfer machine of claim 19 in which the flow enhancer generates a region of low gas pressure.

21. The energy transfer machine of claim 20 in which the flow enhancer is located at a junction between the air intake conduit and the fuel intake conduit.

22. The energy transfer machine of claim 15 in which the carrier has a direction of rotation in normal operation, and the energy transfer machine further comprising a fresh air scavenge conduit located forward on the carrier relative to the air intake conduit in the direction of rotation of the carrier.

23. The energy transfer machine of claim 14 further comprising ignition elements arranged around the outer stator.

24. The energy transfer machine of claim 14 in which each outward projection is provided with a leg and terminates in a foot connected to the leg.

25. The energy transfer machine of claim 14 in which the inner rotor has an effective radius X and rotates within a virtual circle having effective radius R, where R=2X.

26. The energy transfer machine of claim 14 in which the inner rotor has an effective radius X and rotates within a virtual circle having effective radius R, where R is not equal to 2X.

27. The energy transfer machine of claim 1 in which the inward projections define cylinders and the outward projections define pistons acting within the cylinders.

28. The energy transfer machine of claim 1 in which the inward projections and the outward projections are arranged to mesh with each other without circumferential sliding contact.

29. An energy transfer machine, comprising:

an outer stator having inward projections;

a carrier secured for rotation at least partly within the outer stator, said carrier having an exhaust side;

at least one inner rotor secured for rotation about an axis within the carrier, the inner rotor having outward projections;

the inward projections projecting inward and the outward projections projecting outward to mesh with each other and define variable volume chambers between the inward projections and the outward projections as the inner rotor rotates within the carrier; and fluid transfer passages on at least one of the outer stator and carrier to permit flow of fluid into and out of the variable volume chambers, said fluid transfer passages comprising a fuel intake conduit and exhaust plenum on the carrier; wherein the exhaust side of the carrier at least partially incorporates the exhaust plenum;

wherein said energy transfer machine is arranged as an internal combustion engine.

30. The energy transfer machine of claim 29 in which:

the carrier has a direction of rotation in normal operation; and a first portion of the exhaust plenum has an increasing cross-section in the direction of exhaust flow.

31. The energy transfer machine of claim 30 in which a second portion of the exhaust plenum has an increasing cross-section in the direction of exhaust flow.

32. The energy transfer machine of claim 30 in which the plenum surface in the first portion of the exhaust plenum has plural sections, each section being staggered from each other section in the direction of rotation.

33. The energy transfer machine of claim 29 in which the ratio of the number of inward projections to the number of outward projections that mesh with each other to define variable volume chambers is 2:1.

34. The energy transfer machine of claim 33 in which:

the carrier has a direction of rotation in normal operation; and a first portion of the exhaust plenum has an increasing cross-section in the direction of exhaust flow.

35. The energy transfer machine of claim 34 in which a second portion of the exhaust plenum has an increasing cross-section in the direction of exhaust flow.

36. The energy transfer machine of claim 34 in which the plenum surface in the first portion of the exhaust plenum has plural sections, each section being staggered from each other section in the direction of rotation.

* * * * *